US008434178B2

(12) United States Patent
Sobran et al.

(10) Patent No.: US 8,434,178 B2
(45) Date of Patent: May 7, 2013

(54) MATTRESS SIDE/EDGE SUPPORT SYSTEM

(75) Inventors: Ivan Sobran, Raleigh, NC (US); Christopher Dean Page, Nashville, NC (US); James Robert Richmond, Franklinton, NC (US); Jozsef Kertesz, Raleigh, NC (US)

(73) Assignee: Nomaco Inc., Zebulon, NC (US)

( * ) Notice: Subject to any disclaimer, the term of this patent is extended or adjusted under 35 U.S.C. 154(b) by 0 days.

(21) Appl. No.: 13/418,649

(22) Filed: Mar. 13, 2012

(65) Prior Publication Data

US 2012/0167312 A1 Jul. 5, 2012

Related U.S. Application Data

(63) Continuation of application No. 12/455,968, filed on Jun. 10, 2009, now Pat. No. 8,266,747.

(60) Provisional application No. 61/132,920, filed on Jun. 24, 2008.

(51) Int. Cl.
*A47C 17/00* (2006.01)

(52) U.S. Cl.
USPC ..... 5/739; 5/717; 5/680

(58) Field of Classification Search ..... 5/739, 727, 5/723, 400, 678, 680
See application file for complete search history.

(56) References Cited

U.S. PATENT DOCUMENTS

| | | | |
|---|---|---|---|
| 554,580 | A | 2/1896 | Conkwright |
| 676,573 | A | 6/1901 | Bowers |
| 1,429,776 | A | 9/1922 | Robinson |
| 1,979,566 | A | 11/1934 | Morse |
| D105,428 | S | 7/1937 | Bahr |
| D136,717 | S | 11/1943 | Moore et al. |
| 2,337,525 | A | 12/1943 | Peik |
| 2,569,021 | A | 9/1951 | Rozanski |
| 2,615,577 | A | 10/1952 | Bartleman |
| 2,630,145 | A | 3/1953 | Stevens |
| 2,826,769 | A | 3/1958 | Drews |

(Continued)

FOREIGN PATENT DOCUMENTS

| | | | |
|---|---|---|---|
| GB | 2095545 | A | 10/1982 |
| GB | 2154443 | A * | 9/1985 |
| WO | 2009014657 | A1 | 1/2009 |
| WO | 2010117352 | A1 | 10/2010 |

OTHER PUBLICATIONS

Notice of Allowance for U.S. Appl. No. 29/403,050 mailed Sep. 28, 2012, 8 pages.

(Continued)

*Primary Examiner* — Robert G Santos
*Assistant Examiner* — Brittany Wilson
(74) *Attorney, Agent, or Firm* — Withrow & Terranova, PLLC

(57) ABSTRACT

By providing a plurality of preformed components which are quickly and easily affixed in engagement with each other, a final construction is realized which peripherally surrounds any desired mattress configuration in cooperating association therewith. In this way, a new foam plastic product is achieved which is capable of being quickly and easily mounted to mattress constructions peripherally surrounding the mattress and providing an enhanced side support system. In this way, any desired mattress size or configuration is capable of being peripherally surrounded with a foam support assembly for enhancing the mattress construction and configuration. Furthermore, by employing the present invention, a rapid, convenient, and virtually labor free assembly is realized.

19 Claims, 8 Drawing Sheets

U.S. PATENT DOCUMENTS

| | | | | |
|---|---|---|---|---|
| 2,940,089 | A | 6/1960 | Koenigsberg | |
| 2,978,714 | A | 4/1961 | Bechik | |
| 3,046,574 | A | 7/1962 | Erenberg et al. | |
| 3,263,533 | A | 8/1966 | Carlson | |
| 3,293,671 | A | 12/1966 | Griffin | |
| 3,318,224 | A | 5/1967 | Bohanon | |
| 3,749,301 | A | 7/1973 | Peckar | |
| 3,775,526 | A | 11/1973 | Gilmore | |
| 3,822,426 | A | 7/1974 | Mistarz | |
| 3,848,283 | A | 11/1974 | Ikeda | |
| 3,894,706 | A | 7/1975 | Mizusawa | |
| D240,681 | S | 7/1976 | Granatelli | |
| D241,314 | S | 9/1976 | Hug | |
| D245,747 | S | 9/1977 | Ikeda | |
| 4,121,005 | A | 10/1978 | Roberts | |
| 4,181,992 | A | 1/1980 | Blake | |
| 4,207,636 | A | 6/1980 | Ceriani | |
| 4,275,473 | A | 6/1981 | Poirier | |
| D273,659 | S | 5/1984 | Sakaguchi | |
| 4,451,946 | A | 6/1984 | Stumpf | |
| 4,821,988 | A | 4/1989 | Jimenez | |
| 4,907,309 | A | 3/1990 | Breckle | |
| 4,915,662 | A | 4/1990 | Kent | |
| D307,688 | S | 5/1990 | Schaefer | |
| D307,690 | S | 5/1990 | Raburn | |
| D310,313 | S | 9/1990 | Afeyan | |
| 4,998,310 | A * | 3/1991 | Olson | 5/710 |
| 5,005,793 | A | 4/1991 | Shillington | |
| 5,039,366 | A | 8/1991 | Strattman | |
| 5,040,255 | A | 8/1991 | Barber, Jr. | |
| 5,048,167 | A | 9/1991 | Heffley et al. | |
| D322,907 | S | 1/1992 | Raburn | |
| 5,115,524 | A | 5/1992 | Antosko | |
| 5,133,116 | A | 7/1992 | Wagner et al. | |
| 5,195,197 | A | 3/1993 | Gutierrez et al. | |
| 5,239,715 | A | 8/1993 | Wagner | |
| 5,398,820 | A | 3/1995 | Kiss | |
| 5,415,370 | A | 5/1995 | Valiulis | |
| D363,016 | S | 10/1995 | Sipprelle, III et al. | |
| 5,456,437 | A | 10/1995 | Chander et al. | |
| 5,462,212 | A | 10/1995 | Hertel, Jr. | |
| 5,467,488 | A | 11/1995 | Wagner | |
| 5,469,590 | A | 11/1995 | Simon | |
| 5,491,852 | A | 2/1996 | Maucher | |
| 5,537,699 | A | 7/1996 | Bonaddio et al. | |
| D376,309 | S | 12/1996 | Takai | |
| 5,642,557 | A | 7/1997 | Clews | |
| 5,687,439 | A | 11/1997 | Wagner | |
| 5,705,252 | A | 1/1998 | Lea et al. | |
| 5,724,686 | A | 3/1998 | Neal | |
| 5,743,497 | A | 4/1998 | Michael | |
| 5,756,022 | A | 5/1998 | Siegel et al. | |
| 5,787,532 | A | 8/1998 | Langer et al. | |
| 5,792,309 | A | 8/1998 | Eto | |
| 5,815,865 | A | 10/1998 | Washburn et al. | |
| 5,861,205 | A | 1/1999 | Murata et al. | |
| D406,051 | S | 2/1999 | Ross | |
| 5,924,682 | A | 7/1999 | Bullard | |
| D413,035 | S | 8/1999 | Weterrings et al. | |
| 5,987,678 | A | 11/1999 | Ayers | |
| D417,612 | S | 12/1999 | Jones | |
| 6,003,179 | A | 12/1999 | Farley | |
| D418,354 | S | 1/2000 | O'Rourke | |
| 6,023,803 | A | 2/2000 | Barman | |
| 6,026,525 | A | 2/2000 | Davis | |
| 6,109,569 | A | 8/2000 | Sakaida | |
| 6,122,787 | A | 9/2000 | Kao | |
| D432,404 | S | 10/2000 | Garfinkle | |
| 6,154,908 | A | 12/2000 | Wells | |
| D436,772 | S | 1/2001 | Soderstrom | |
| 6,243,894 | B1 | 6/2001 | Kosumsuppamala et al. | |
| 6,260,331 | B1 | 7/2001 | Stumpf | |
| 6,263,533 | B1 | 7/2001 | Dimitry et al. | |
| 6,286,166 | B1 | 9/2001 | Henley et al. | |
| 6,295,676 | B1 | 10/2001 | Warner | |
| 6,306,235 | B1 | 10/2001 | Henderson | |
| 6,315,275 | B1 | 11/2001 | Zysman | |
| D454,740 | S | 3/2002 | Baggott | |
| 6,353,952 | B1 | 3/2002 | Wells | |
| D456,197 | S | 4/2002 | McClure et al. | |
| 6,370,717 | B1 | 4/2002 | Kao | |
| 6,398,199 | B1 | 6/2002 | Barber | |
| D467,117 | S | 12/2002 | Guy | |
| 6,488,031 | B1 | 12/2002 | Sells, II | |
| 6,496,993 | B2 | 12/2002 | Allen et al. | |
| 6,523,812 | B1 | 2/2003 | Spinks et al. | |
| 6,537,405 | B1 | 3/2003 | Henderson et al. | |
| 6,568,014 | B1 | 5/2003 | Sabalaskey et al. | |
| 6,574,814 | B2 | 6/2003 | Collard et al. | |
| 6,612,525 | B2 | 9/2003 | Bagdi | |
| 6,658,682 | B1 | 12/2003 | Wells | |
| 6,684,434 | B2 | 2/2004 | Ellis et al. | |
| 6,721,981 | B1 | 4/2004 | Greenhalgh et al. | |
| 6,772,463 | B2 * | 8/2004 | Gladney et al. | 5/739 |
| 6,813,791 | B2 | 11/2004 | Mossbeck et al. | |
| 6,826,796 | B1 | 12/2004 | Mossbeck | |
| 6,832,397 | B2 * | 12/2004 | Gaboury et al. | 5/201 |
| 6,862,763 | B2 | 3/2005 | Mossbeck et al. | |
| 6,883,196 | B2 | 4/2005 | Barber | |
| 6,898,813 | B2 | 5/2005 | Grothaus | |
| D506,385 | S | 6/2005 | Brown | |
| 6,954,957 | B2 | 10/2005 | Metzger et al. | |
| 6,966,090 | B2 | 11/2005 | McClintock et al. | |
| 6,966,091 | B2 | 11/2005 | Barber | |
| 7,017,205 | B2 | 3/2006 | Gladney | |
| 7,028,352 | B2 | 4/2006 | Kramer et al. | |
| 7,036,173 | B2 | 5/2006 | Gladney | |
| 7,044,557 | B2 | 5/2006 | Wieland | |
| 7,082,635 | B2 | 8/2006 | Barman et al. | |
| 7,093,858 | B1 | 8/2006 | Russell | |
| 7,127,765 | B2 | 10/2006 | Ruiz | |
| 7,165,282 | B2 * | 1/2007 | Watson | 5/739 |
| D537,331 | S | 2/2007 | Hill | |
| 7,178,187 | B2 | 2/2007 | Barman et al. | |
| 7,185,379 | B2 | 3/2007 | Barman | |
| 7,185,770 | B1 | 3/2007 | Roten | |
| 7,194,777 | B2 | 3/2007 | Edling et al. | |
| 7,210,181 | B1 | 5/2007 | Price | |
| 7,251,847 | B2 | 8/2007 | Wells | |
| D569,160 | S | 5/2008 | Mossbeck | |
| D581,715 | S | 12/2008 | Scheuch | |
| D583,607 | S | 12/2008 | Hanson et al. | |
| 7,546,648 | B2 * | 6/2009 | Steffes | 5/400 |
| 7,597,296 | B2 | 10/2009 | Conway | |
| 7,608,782 | B2 | 10/2009 | Hill | |
| 7,644,461 | B2 | 1/2010 | Lee | |
| D612,188 | S | 3/2010 | Yiannaki | |
| 7,685,664 | B2 | 3/2010 | Stolpmann et al. | |
| 7,805,790 | B2 | 10/2010 | DeMoss | |
| 7,841,031 | B2 | 11/2010 | Rawls-Meehan | |
| 7,845,035 | B2 | 12/2010 | Letton et al. | |
| 7,845,036 | B2 | 12/2010 | Rinchetti | |
| 7,865,988 | B2 | 1/2011 | Koughan et al. | |
| D636,622 | S | 4/2011 | Quinter et al. | |
| D640,535 | S | 6/2011 | Austro | |
| D642,413 | S | 8/2011 | Rinehart | |
| D642,847 | S | 8/2011 | Rinehart | |
| 7,992,712 | B2 | 8/2011 | Rosland | |
| 8,001,638 | B1 * | 8/2011 | Quinter et al. | 5/722 |
| D648,211 | S | 11/2011 | Weaver et al. | |
| D653,895 | S | 2/2012 | Reisenhus | |
| D665,449 | S | 8/2012 | Guirlinger | |
| 8,250,689 | B2 | 8/2012 | Gladney | |
| 2002/0069462 | A1 | 6/2002 | Gaboury et al. | |
| 2003/0074736 | A1 | 4/2003 | Grothaus | |
| 2003/0079284 | A1 | 5/2003 | Gaboury et al. | |
| 2003/0173814 | A1 | 9/2003 | Wieland et al. | |
| 2004/0128761 | A1 | 7/2004 | Gaboury et al. | |
| 2004/0128773 | A1 | 7/2004 | Barber | |
| 2004/0133988 | A1 | 7/2004 | Barber | |
| 2004/0182802 | A1 | 9/2004 | Paul | |
| 2004/0187217 | A1 | 9/2004 | Barman et al. | |
| 2004/0261186 | A1 | 12/2004 | Gladney | |
| 2005/0015884 | A1 * | 1/2005 | Conaway et al. | 5/739 |
| 2005/0028275 | A1 | 2/2005 | Hooper, Jr. | |
| 2005/0204475 | A1 | 9/2005 | Schmitz et al. | |
| 2005/0246839 | A1 | 11/2005 | Niswonger | |

| | | | | |
|---|---|---|---|---|
| 2005/0251920 | A1 | 11/2005 | Ahn | |
| 2005/0262642 | A1 | 12/2005 | Miller | |
| 2006/0031995 | A1 * | 2/2006 | Barkhouse | 5/690 |
| 2006/0042016 | A1 | 3/2006 | Barman et al. | |
| 2006/0260062 | A1 | 11/2006 | Barman et al. | |
| 2007/0118987 | A1 | 5/2007 | Gladney et al. | |
| 2008/0040861 | A1 | 2/2008 | Ootayopas | |
| 2008/0115288 | A1 | 5/2008 | Poulos | |
| 2009/0000030 | A1 * | 1/2009 | Hicks et al. | 5/400 |
| 2009/0011203 | A1 | 1/2009 | Mock et al. | |
| 2009/0013476 | A1 | 1/2009 | Rinchetti | |
| 2009/0025150 | A1 * | 1/2009 | Smalling et al. | 5/718 |
| 2009/0031502 | A1 | 2/2009 | Berrcocal et al. | |
| 2009/0100606 | A1 | 4/2009 | An | |
| 2009/0106894 | A1 | 4/2009 | Yeo | |
| 2009/0139033 | A1 | 6/2009 | Gladney | |
| 2009/0294623 | A1 | 12/2009 | Pinchuk | |
| 2010/0071136 | A1 | 3/2010 | Weber | |
| 2010/0077552 | A1 | 4/2010 | Malikhin et al. | |
| 2010/0319137 | A1 | 12/2010 | Witherell et al. | |
| 2010/0325806 | A1 | 12/2010 | Letton et al. | |
| 2011/0049327 | A1 | 3/2011 | Young et al. | |
| 2011/0179579 | A1 | 7/2011 | Henderson et al. | |
| 2011/0197368 | A1 | 8/2011 | Tarazona De La Asuncion | |
| 2012/0167312 | A1 | 7/2012 | Sobran et al. | |
| 2012/0180224 | A1 | 7/2012 | Demoss et al. | |
| 2012/0284928 | A1 | 11/2012 | Henderson et al. | |

OTHER PUBLICATIONS

"Expandable Grids Made of ETHOFOAM Brand Polyethylene Foam," ETHAFOAM, Dec. 1997, 7 pages.

Notice of Allowance mailed Dec. 31, 2009 for U.S. Appl. No. 29/342,503, 4 pages.

Non-final Office Action mailed Sep. 13, 2011 for U.S. Appl. No. 12/386,584, 18 pages.

Non-final Office Action for U.S. Appl. No. 12/386,584 mailed Feb. 3, 2012, 17 pages.

Final Office Action mailed Nov. 8, 2010 for U.S. Appl. No. 12/455,968, 13 pages.

Non-final Office Action mailed May 26, 2010 for U.S. Appl. No. 12/455,968, 13 pages.

Non-final Office Action mailed Oct. 12, 2011 for U.S. Appl. No. 12/455,968, 12 pages.

Notice of Allowance for U.S. Appl. No. 29/342,503 mailed Dec. 16, 2009, 6 pages.

Non-final Office Action for U.S. Appl. No. 29/398,647 mailed May 8, 2012, 6 pages.

Notice of Allowance mailed May 9, 2012, for U.S. Appl. No. 29/398,649, 8 pages.

Notice of Allowance for U.S. Appl. No. 12/455,968 mailed Jul. 23, 2012, 7 pages.

Non-final Office Action for U.S. Appl. No. 12/870,316 mailed Aug. 21, 2012, 12 pages.

Notice of Allowance for U.S. Appl. No. 29/398,649 mailed Aug. 29, 2012, 6 pages.

Notice of Allowance for U.S. Appl. No. 29/398,647 mailed Aug. 30, 2012, 6 pages.

Quayle Action for U.S. Appl. No. 29/361,180 mailed Sep. 13, 2012, 11 pages.

Notice of Allowance for U.S. Appl. No. 29/361,180 mailed Nov. 27, 2012, 6 pages.

* cited by examiner

FIG. 2
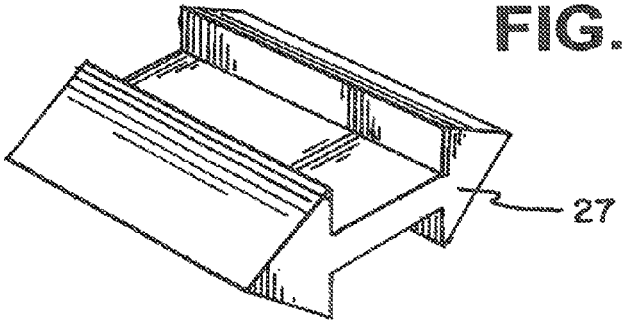
FIG. 3
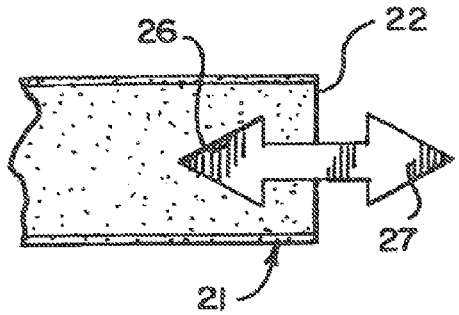
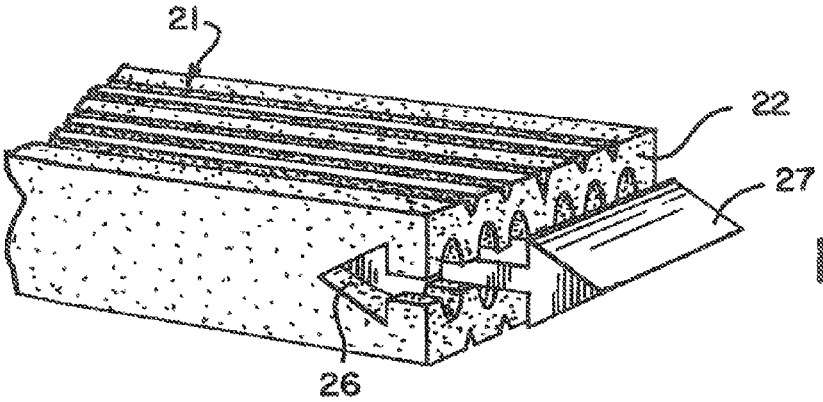
FIG. 4
FIG. 5
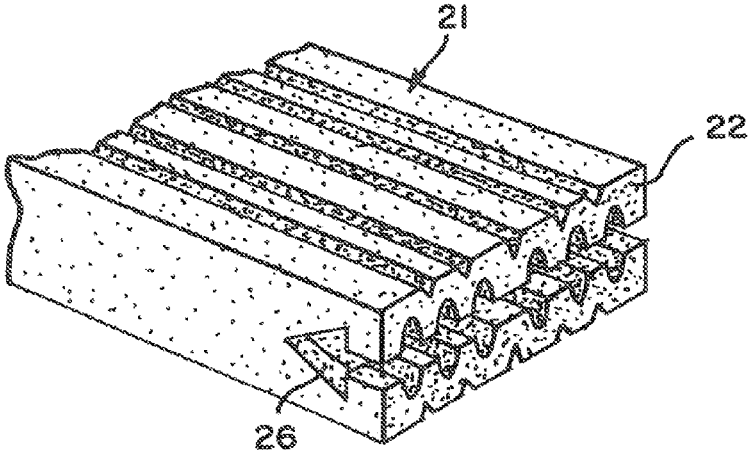

FIG. 9
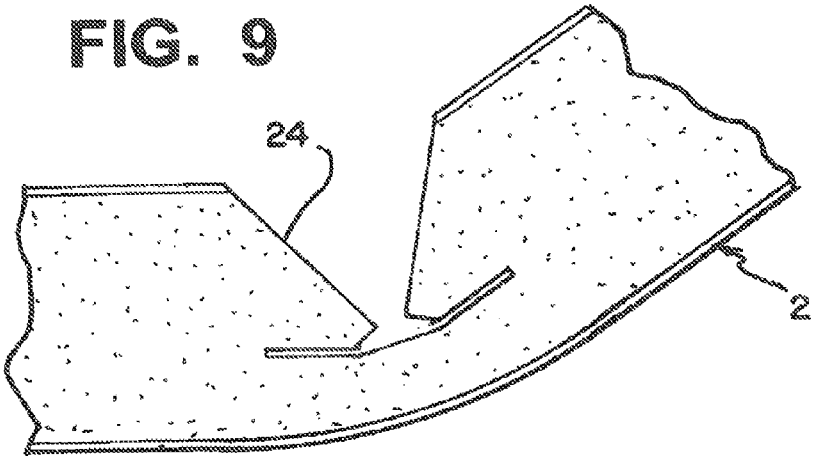
FIG. 10
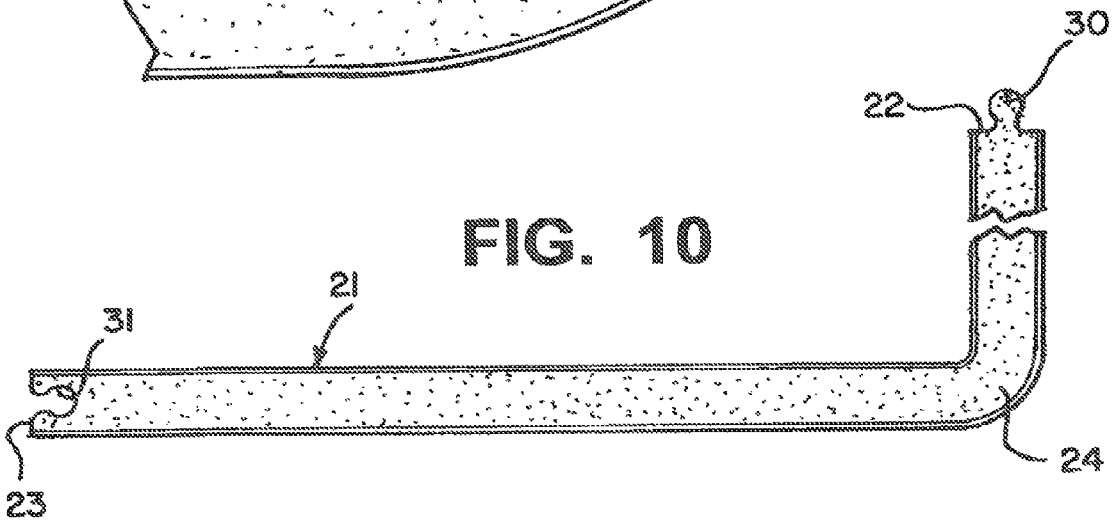
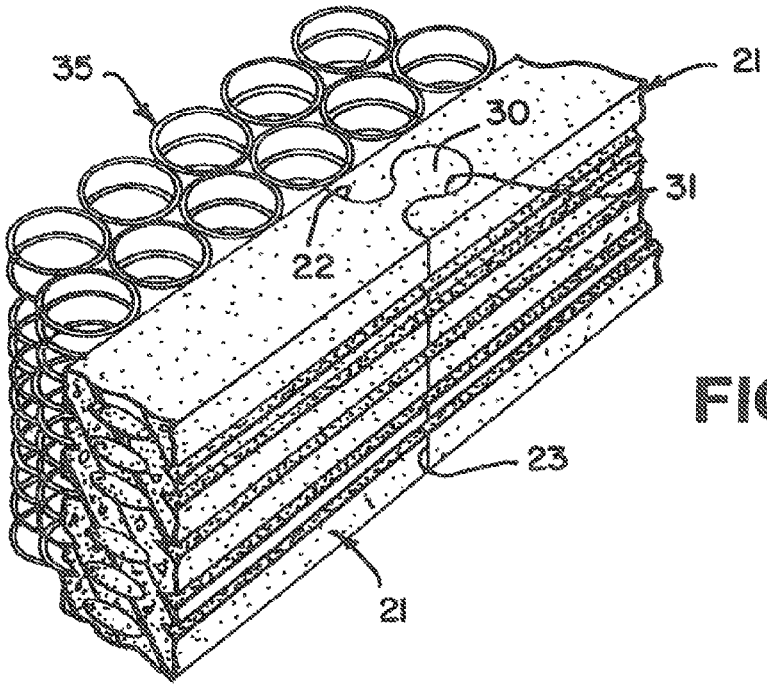
FIG. 11

FIG. 12
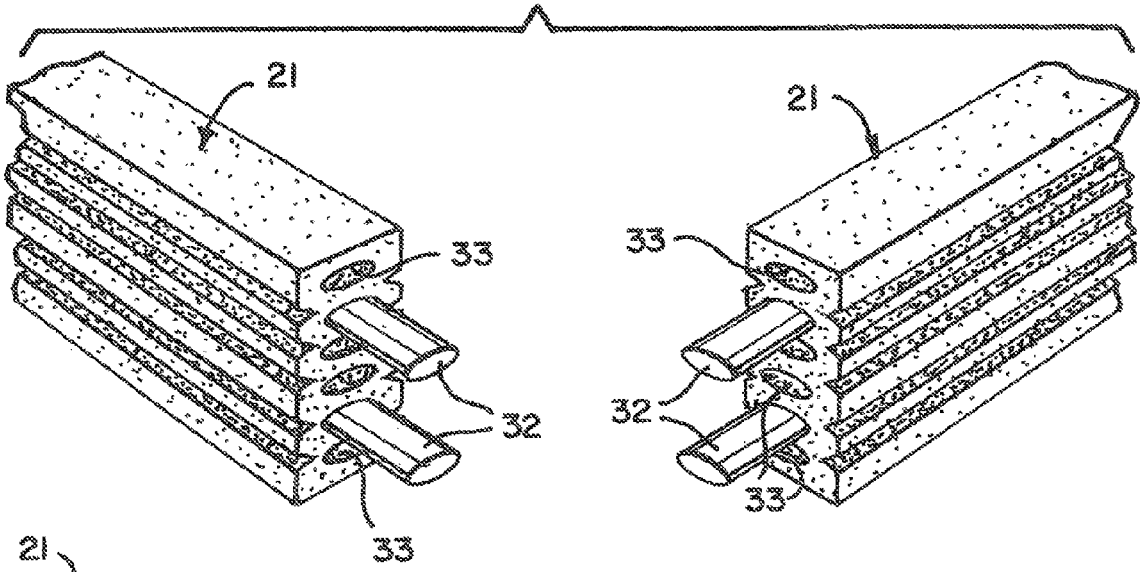
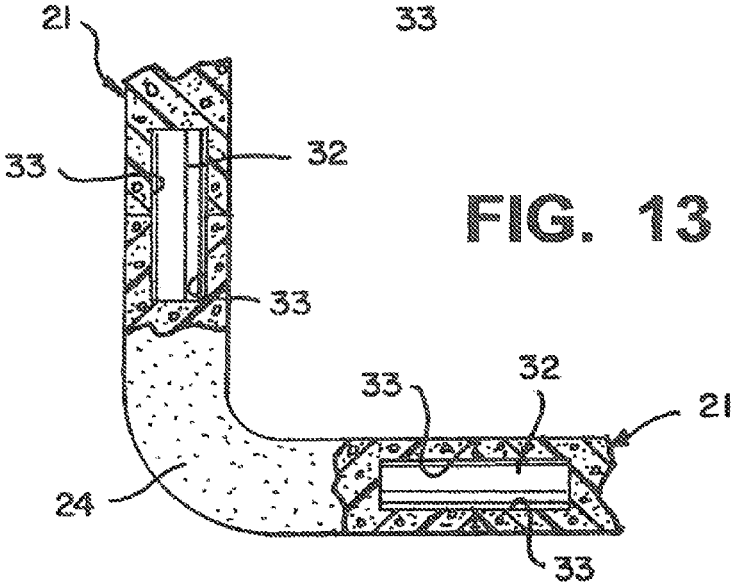
FIG. 13
FIG. 14
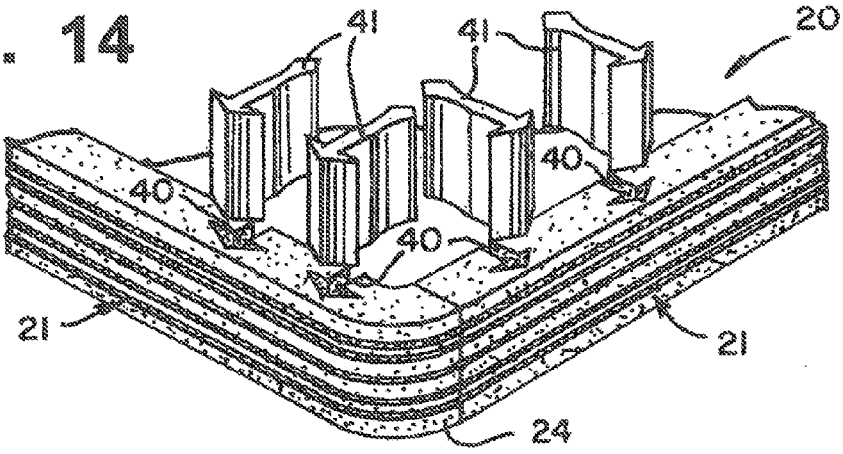

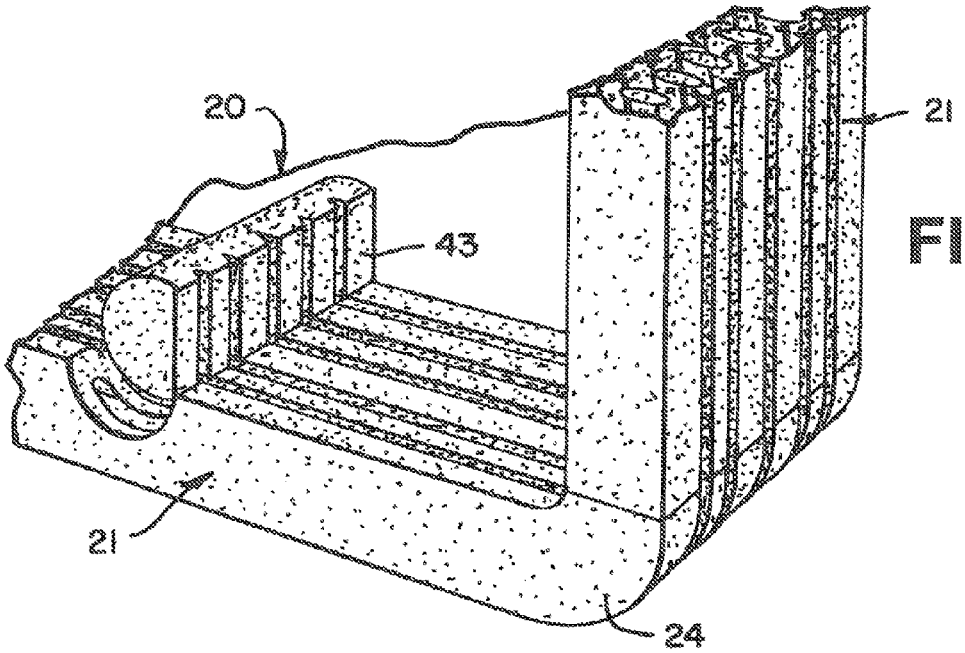
FIG. 18
FIG. 19
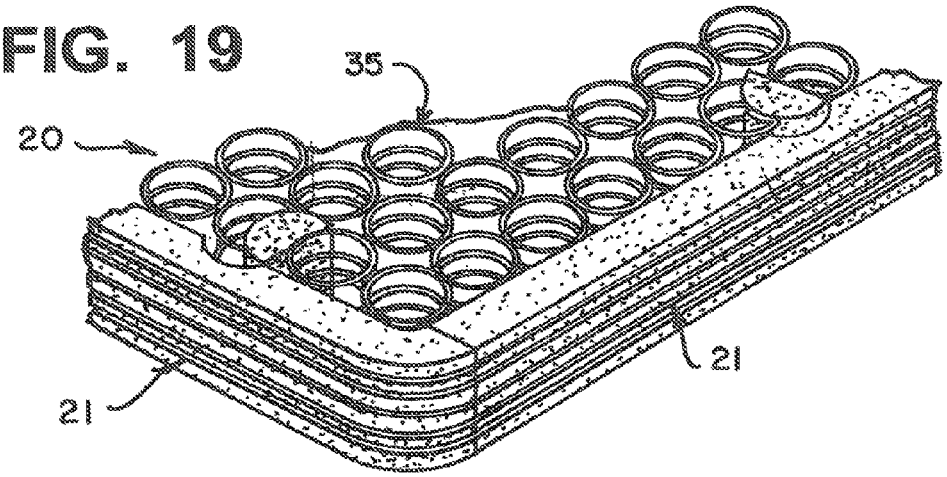
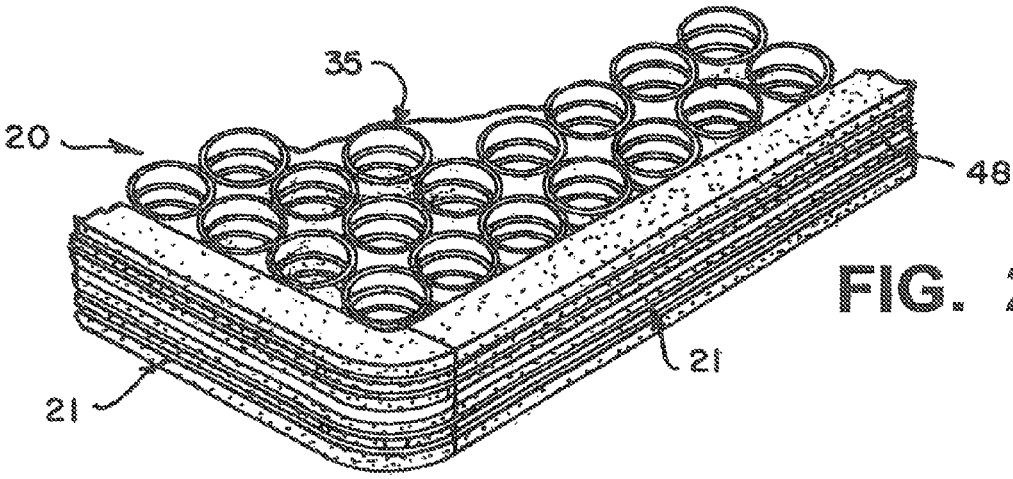
FIG. 20

MATTRESS SIDE/EDGE SUPPORT SYSTEM

RELATED APPLICATIONS

This application is a continuation application of and claims priority to co-pending U.S. patent application Ser. No. 12/455,968 entitled "Mattress Side/Edge Support System," filed Jun. 10, 2009, which is incorporated herein by reference in its entirety.

This application is related to and claims priority to U.S. Provisional Patent Application Ser. No. 61/132,920 entitled "Mattress Side/Edge Support System," filed Jun. 24, 2008, which is incorporated herein by reference in its entirety.

BACKGROUND

1. Field of the Disclosure

This invention relates to foam panel constructions and, more particularly, to foam panel constructions which are capable of being employed as side supports for mattresses.

2. Technical Background

Throughout the years, an ever increasing variety of products and product areas have benefitted from the use of foam plastic materials. In this regard, product manufacturers, suppliers, and/or shippers have found that foam plastic products, materials, and profiles can be employed for improving the quality of the product being produced, as well as for substantially improving the strength, rigidity and function of numerous products. Furthermore, due to the unique nature of foam plastic products and the ability of these products to be formed in various sizes, shapes, and configurations, these products have enjoyed increased acceptance and use.

As the abilities, capabilities, and versatility of foam plastic material became known to individuals and corporate entities, the popularity of foam plastic products substantially increased, along with the wide variety of product areas and purposes for which foam plastic products were employed. In this regard, foam plastic material has been used for protecting small fragile products such as those made from glass, as well as protecting large products made from metal or similar materials, such as refrigerators, stoves, and the like. In these large products, foam plastic panels are often employed to peripherally surround the product and protect the outer surfaces of the product.

In addition, foam plastic materials have also been employed in numerous other products as an integral component of the product. In this area, furniture, bedding, and mattresses have employed foam plastic materials as an integral component incorporated into the product structure itself. In this instance, foam plastic materials have proven to be effective in providing support and integrity to the product as a replacement for components which are more expensive and more difficult to employ.

In this regard, foam plastic material has been employed in mattress constructions as a replacement for other materials or for improved constructions. In particular, foam plastic materials have been used as side supports for mattresses and the use of foamed polymer side supports for mattresses has brought considerable benefits for both the bed manufacturer and the consumer. In general, side supports surround the entire perimeter of the mattress.

One benefit of incorporating side support systems on mattresses is the ability of the side support to change the characteristics of the edges of a mattress so that they are different from those of the main sleeping surface. For example, the side supports help prevent "roll-off" (the phenomenon whereby the softness of a mattress or cushion causes it to compress so that when a person sits or lies on the edge, they tend to fall off). Their presence also extends the effective sleep surface of a bed by some 10-15%. An additional benefit is to provide improved aesthetic appearance around the vertical border of a mattress (for example both spring based and air-filled mattresses), giving it tighter and crisper corners. With the exception of some of their lower priced products, all bed manufacturers use some form of edge support.

Side support systems in commercial use are made from foamed polyurethane or from foamed polyolefines. The foamed polyurethane systems are typically in the form of rectangular blocks laid out in a rectangle surrounding a mattress, or can be foamed in place as a single part surrounding the springs. The decision on which side support system to use depends on factors such as cost, weight, compression resistance, resilience, ease of manufacture and odor and moisture adsorption.

A problem with the loose blocks of foam (typically polyurethane) is restraining them accurately during the manufacturing process of the mattress. They have to remain in place during the subsequent manufacturing operations of adding sleep surface layers and wrapping the bed in fabric, including flame retardant layers, and then sewing. These problems are exacerbated as the foam density is decreased because the weight of each side support component is reduced, making them extremely difficult to hold in position. Such products are therefore typically restricted to systems that are assembled by the consumer, such as Select Comfort's Sleep Number 5000 beds.

Some manufacturers have overcome this problem with assembly by adding multiple "keys" welded at right angles to the side support. These keys push snugly between the metal springs, to hold the side support securely in place during the manufacturing process and subsequent use as a mattress. Although these keys work very well, they are applied in a secondary operation (welding or gluing) and also have the disadvantage that the side supports do not pack closely because the pieces are kept apart by the keys. This reduced packing efficiency increases warehousing and transport costs significantly. A typical side support system using keys consists of four foamed parts that together completely surround the perimeter of the mattress. The pieces are not joined together but are held securely in place by the keys described above.

The continued requirement for marketing appeal, product cost reduction and performance improvement, combined with reduced manufacturing complexity has motivated the search for alternative systems for side support. There is also a trend to increase the width of the side support to provide more comfort and an improved performance (softness, feel, absence of the harder edge resulting from the springs) to the edge of the mattress.

Therefore, it is a principal object of the present invention to provide a side support system which incorporates a plurality of separate and independent side forming elements or segments which are constructed for being quickly and easily mounted peripherally surrounding a mattress assembly while simultaneously being securely affixed to each other.

Another object of the present invention is to provide a plurality of separate and independent side forming elements/segments which are quickly and easily mounted in secure, locked interengagement without requiring extensive or expensive manual labor.

Another object of the present invention is to provide a side support system which is capable of being shipped in a small, compact area or package, while also being easily removed from said package and mounted to the desired mattress assembly.

A further object of the present invention is to provide a side support system which is capable of being manufactured efficiently and economically, for enabling the entire side support system to be manufactured and assembled at highly competitive costs.

Other and more specific objects will in part be obvious and will in part appear hereinafter.

SUMMARY OF THE DETAILED DESCRIPTION

By employing the present invention, all of the difficulties and drawbacks found in prior art constructions have been overcome and a new, unique, foam plastic product is achieved which is capable of being quickly and easily mounted to mattress constructions peripherally surrounding the mattress and providing an enhanced side support system. In this way, any desired mattress size or configuration is capable of being peripherally surrounded with a foam support assembly for enhancing the mattress construction and configuration. As a result, mattresses incorporating the side support system of the present invention achieve greater versatility and benefit from numerous consumer enhancements, while also achieving ease, speed and convenience of installation.

In the preferred construction of the side support system of the present invention, a plurality of preformed components are quickly and easily affixed in engagement with each other, achieving a final construction which peripherally surrounds any desired mattress configuration in cooperating association therewith. Furthermore, by employing the present invention, a rapid, convenient, and virtually labor free assembly is realized.

In order to achieve these desirable results, the side support system of the present invention incorporates, in one preferred embodiment, a plurality of segments which are identical or virtually identical to each other. With each segment being capable of locking interengagement with adjacent segments, any desired mattress construction can be quickly and easily enhanced by peripherally surrounding the mattress construction with the side support system of this invention. Furthermore, each segment is preferably constructed in a manner which provides nested, compact engagement or stacking of the segments in order to assure that the segments are capable of being easily packaged and transported in a compact area.

In an alternate preferred embodiment, a plurality of segments are employed which incorporate a plurality of groups of substantially identical segments. In this way, the mattress construction is capable of being quickly and easily peripherally surrounded by the side support system of the present invention by positioning specific groups of identical segments in similar locations for achieving the desired final construction.

Although the side support system of the present invention may be constructed using a plurality of segments with each segment having different lengths and shapes, or may be constructed with various alternate segment configurations, the preferred construction employs four virtually identically dimensioned segments. In addition, each segment incorporates a 90° corner forming portion. In this way, by positioning the four corner forming segments in separate locations peripherally surrounding the mattress construction, the desired peripherally surrounding side support system is realized and fully assembled quickly and easily.

Regardless of the segment configuration employed for the side support system of the present invention, each segment is constructed (1) for locking interengagement with adjacent segments, (2) for locking engagement with the coil spring members forming the principal mattress support, or (3) as a combination of both constructions. In this way, the assembly of the entire peripherally surrounding side support system is quickly and easily achieved.

In this regard, as detailed herein, numerous alternate configurations and constructions can be employed for realizing rapid, locking interengagement of each segment with its adjacent segments and/or the mattress assembly itself. In addition, the construction employed for achieving the desired locking interengagement is implemented independently, without requiring the use of conventional joining material, such as tape, hook and loop fasteners, adhesives, welding, and the like.

In one embodiment of the present invention, adjacent segments are lockingly interconnected with each other by employing separate interlocking elements or integrally formed locking elements. In implementing this embodiment of the present invention, separate locking elements having a particular configuration are inserted into receiving cavities formed at desired locations on adjacent segments. In this way, by quickly and easily inserting the locking element into the receiving cavities, adjacent segments are quickly and easily lockingly interengaged with each other.

In one form of this embodiment, the locking elements are integrally formed with each segment, with one segment incorporating a locking element protruding or extending therefrom, which is insertable into a receiving cavity formed in an adjacent segment. Once the desired interconnection is achieved, the segments are securely affixed to each other. In addition, each segment may incorporate complementary configurations for providing the desired locked interengagement.

Either independently or in combination with these locking element embodiments, separate and independent locking members can be formed which are constructed for being securely engaged with the inside surface of the segment, resulting in a locking member extending from the side surface of the segment substantially perpendicularly thereto. In this way, the outwardly extending locking member is able to be quickly and easily inserted between the coil spring members of the mattress support, for securely affixing the side support to the mattress assembly, if said locking members are used independently, or for adding additional locking engagement with the mattress assembly if the outwardly extending locking members are used in addition to locking elements for affixing adjacent segments to themselves.

In a further alternate embodiment, locking members can be integrally formed with the side support and constructed for arcuately pivoting outwardly from the side support for engagement with the coil spring members. In this way, separate locking members are not required since in the locking, members integrally formed as components of the side support are employed for securely affixing the side support to the mattress assembly.

In a still further embodiment of the present invention, the side support forming segments can be constructed for cooperating with tensioning components used to maintain the side support segments in the desired position. In this regard, in one construction of this embodiment, an elongated elastic tape or band member can be employed for peripherally surrounding the outer surface of the segments for maintaining the segments in the desired position in complete engagement with the mattress assembly. If desired, the elastic tape or band members can be positioned in a receiving cavity or channel for effectively concealing the visibility of the tape or band.

Finally, a still further alternate embodiment of the present invention employs a mechanical hook and/or clip assembly which lockingly engages the coil spring members and is interconnected with the segments forming the side support. By employing this embodiment, a mechanical fastening system is quickly and easily achieved for securely affixing the side support segments to the mattress assembly.

The invention accordingly comprises an article of manufacture possessing the features, properties, and the relation of elements which will be exemplified in the article hereinafter described, and the scope of the invention will be indicated in the claims.

BRIEF DESCRIPTION OF THE FIGURES

For a fuller understanding of the nature and objects of the invention, reference should be had to the following detailed description taken in connection with the accompanying drawings, in which:

FIG. 2 is a perspective view of a locking element employed in the side support system of FIG. 1;

FIG. 3 is a top plan view of one side support forming element/segment of the side to support system of the present invention incorporating a locking element mounted therein;

FIG. 4 is a top perspective view of the side support forming element/segment of FIG. 3;

FIG. 5 is a top perspective view of the side support forming element/segment of FIG. 4 with the locking element removed therefrom;

FIG. 9 is a top view of an alternate embodiment of the side support forming element/segment of the present invention depicted in the process of being moved into its assembled position;

FIG. 10 is a top plan view of an alternate embodiment of the side support forming element/segment of the present invention;

FIG. 11 is a perspective view of the side support forming element/segment of FIG. 10 depicted in mounted engagement with an adjacent side support forming element in association with a mattress assembly;

FIG. 12 is a perspective view of still further alternate embodiments of the side support forming element/segment of the present invention depicted prior to assembly;

FIG. 13 is a top plan view of the side support forming element/segment of FIG. 12 depicted in an assembled configuration;

FIG. 14 is a perspective view of a still further alternate embodiment of the side support system of the present invention;

FIG. 18 is a perspective view of the side support forming element/segment of FIG. 17;

FIG. 19 is a perspective view of the side support system of FIG. 16 shown with the side support forming element/segments thereof in mounted interengagement with a mattress assembly;

FIG. 20 is a perspective view of a still further alternate embodiment of the side support system of the present invention wherein an elastic band is employed to hold side support forming element/segments securely mounted to the mattress assembly.

DETAILED DESCRIPTION

Figure 1:
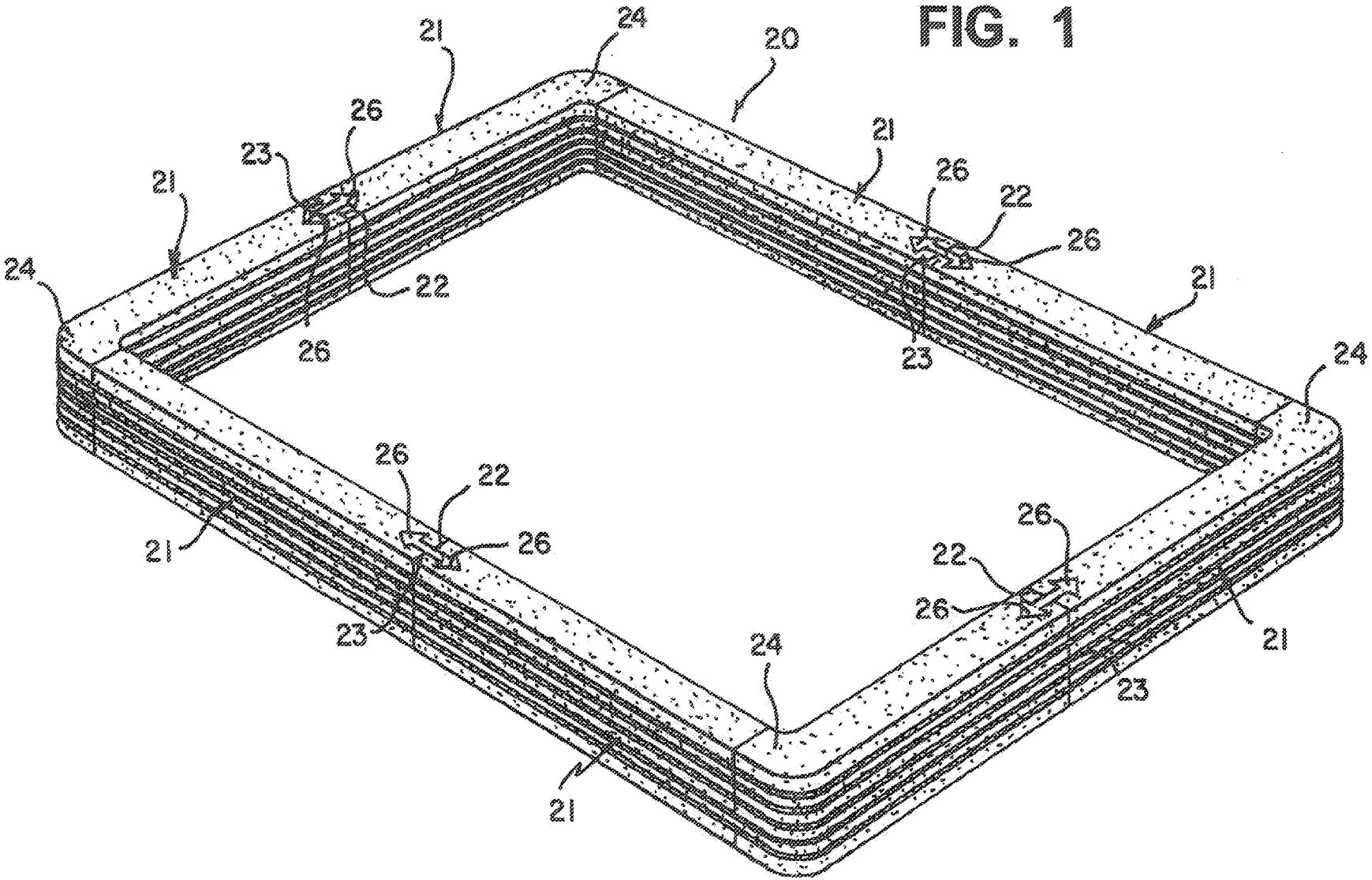
FIG. 1 is a perspective view of one embodiment of a fully assembled side support system made in accordance with the present invention.

By referring to FIGS. 1-21, along with the following detailed discussion, several alternate embodiments of the present invention can best be understood. However, further alternate embodiments can be implemented without departing from the scope of this invention. Consequently, it is also to be understood that the following disclosure, as well as the drawings, are provided for exemplary purposes only and are not intended as a limitation of the present invention.

In FIGS. 1-6, one preferred embodiment of side support system 20 of the present invention is fully depicted. In this embodiment, side support system 20 comprises a plurality of side support forming elements or segments 21, each of which are substantially identical in construction. In this preferred embodiment, each side support forming element/segment 21 is formed from an elongated length of foam plastic material incorporating opposed terminating ends 22 and 23. Furthermore, each side support forming element 21 is constructed to incorporate a right angle or 90° transition portion 24 integrally formed therein.

As depicted, and further detailed below, right angle or 90° transition portion 24 can be constructed with a hinged portion formed therein for enabling substantially continuous elongated components to be arcuately pivoted into the 90° configuration or, alternatively, integrally formed as a 90° structure. Regardless of which embodiment is employed, the advantages provided by the present invention are achieved.

In this preferred embodiment, each side support forming element/segment 21 is quickly and easily positioned about any desired mattress configuration in cooperating association therewith, with terminating ends 22 and 23 of each side support forming element/segment 21 placed in abutting contact with each other. In addition, in order to enable the plurality of side support forming elements/segments 21 to be quickly and easily securely affixed to each other in peripherally surrounding engagement with the desired mattress configuration, side support forming elements/segments 21 incorporate securing means.

In order to achieve rapid, secure, and trouble-free interengagement of elements/segments 21 with each other, each side support forming element/segment 21 incorporates locking member receiving cavity 26 formed in terminating ends 22 and 23. In addition, receiving cavity 26 is constructed with a precisely desired size and shape for receiving and lockingly interengaging with locking member 27.

In the preferred embodiment, as depicted in FIGS. 1-6, locking member 27 is constructed as an enlarged block or wall member having a cross-sectional shape generally configured as a double headed arrow. In this way, locking member 27 is quickly and easily inserted into receiving cavity 26 of side support forming elements/segments 21 and securely, lockingly interengaged with terminating ends 22 and 23 of cooperating element/segment 21.

By employing this preferred embodiment, wherein locking member 27 comprises double arrowheads formed at both ends thereof, locking interengagement with terminating end 22 of one side support forming element/segment 21 is quickly achieved simultaneously with locking inter-engagement with terminating end 23 of the adjacent side support forming element/segment 21. As a result, this embodiment of the present invention achieves a side support system 20 which is quickly and easily placed in peripherally surrounding engagement with any desired mattress construction and securely lockingly engaged in the precisely desired position.

In addition, the portion of locking member 27 which interconnects and the double arrow heads is preferably constructed with a cross-sectional size and shape which inherently resists bending or movement in response to any force imposed thereon at substantially right angles to the overall length of locking member 27. In addition, the size and shape of each arrowhead is also constructed with sufficient dimension to resist any bending or twisting in response to forces imposed on locking member 27 at right angles thereto.

By constructing locking member 27 in this manner, the insertion of locking member 27 in receiving cavities 26 of side support forming elements/segments 21 provides a uniform rectangular side support construction that peripherally surrounds the mattress assembly and closely or snugly engages the helical coil springs forming the mattress assembly about the entire outer perimeter surface. In this way, movement of the side support system away from the mattress assembly is prevented and the imposition of any force at substantially right angles to the side support system is resisted and is incapable of producing any unwanted disengagement, dislodgment, bulging or outward bending.

Although the preferred embodiment of locking member 27 comprises a double headed arrow shape, numerous alternate shapes and configurations can be employed without departing from the scope of this invention. In this regard, alternate shapes for locking member 27 may comprise one or more selected from the group consisting of dovetails, teardrops, jigsaws, rhombuses, semicircles, bowties, and the like.

In constructing locking member 27, any desired shape can be employed provided the parts cannot be easily separated by exerting a force at right angles to the direction in which the parts are inserted with one another. In addition, locking member 27 may be formed with two separate and distinct shapes being employed at opposed end thereof. In this regard, the only requirement is that receiving cavity 26 of side support forming element/segment 21 must be configured in a manner to enable easy insertion and locked interengagement therewith.

Furthermore, as discussed above, the configuration of locking member 27 preferably comprises a structure or shape which prevents and virtually eliminates any tendency of locking member 27 to bend or twist in response to the imposition of a force at substantially right angles thereto. In this way, the resulting side support system peripherally surrounds the mattress assembly and remains in close contacting engagement therewith. Furthermore, by employing locking members 27 having these physical characteristics, bending, bulging, disengagement or dislodgment of the side support system from the mattress assembly is prevented, and a side support system which provides optimum performance characteristics is achieved.

As is evident from the foregoing discussion, the present invention achieves this secure, locked interengagement of cooperating side support forming elements/segments 21 without requiring the use of conventional joining materials. As a result, fastening materials such as tape, hook and loop fasteners, adhesives, welding, and the like are completely eliminated, and rapid locking interengagement of cooperating components is achieved quickly, easily, and expeditiously.

In FIG. 1, one embodiment of side support forming element/segment 21 is depicted wherein each side support forming element/segment 21 comprises a generally rigid 90° or right angle portion 24. By constructing each side support forming element or segment 21 with a rigid right angle portion 24, no further assembly is required and elements or segments 21 can be quickly and easily positioned in the precisely desired location about a desired mattress construction, and then merely securely locked in interengagement with each other.

Figure 6:
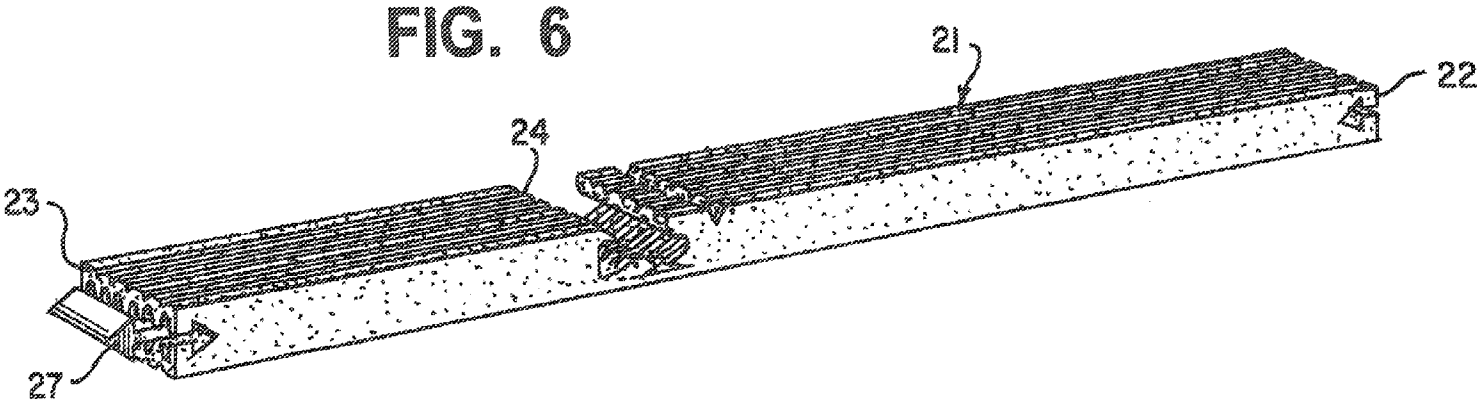
FIG. 6 is a perspective view of one embodiment of the side support forming element/segment of FIG. 1 shown in its open, preassembled configuration.

Alternatively, side support forming elements or segments 21 may incorporate a hinged construction, as depicted in FIG. 6, which enables each element or segment 21 to be shipped in an elongated, substantially flat and straight configuration. Once assembly is desired, the cooperating portions of side support forming element/segment 21 are arcuately pivoted towards each other, forming the desired right angle portion 24. Regardless of which embodiment is employed, the rapid and easily achieved installation of side support system 20 of the present invention is realized. Furthermore, it has also been found that either embodiment is capable of being packaged in small, compact and confined containers, thereby minimizing shipping costs for either embodiment.

Figure 8:
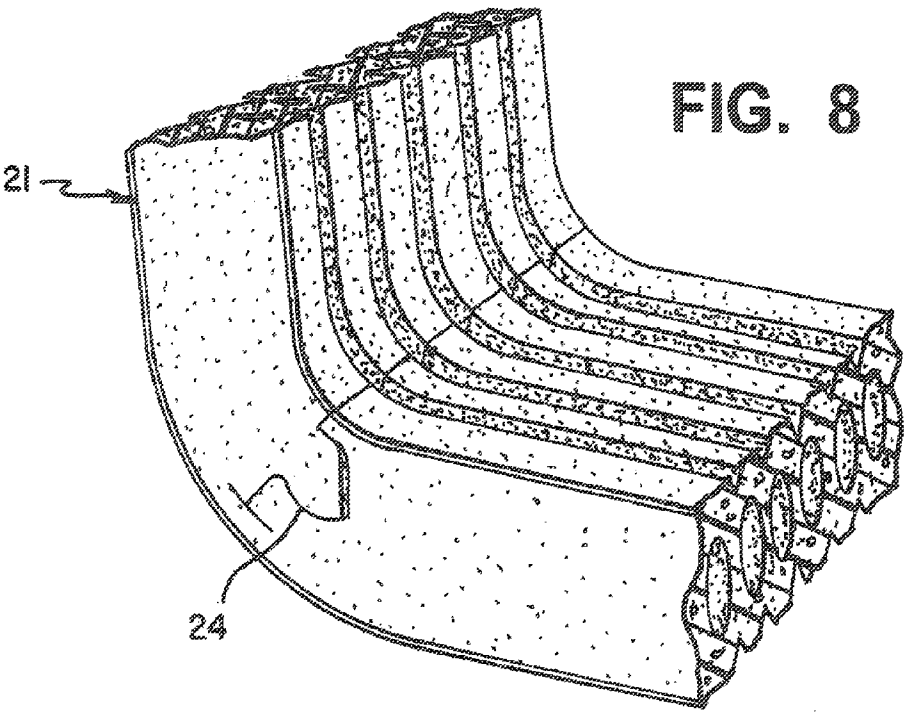
FIG. 8 is a top perspective view, partially broken away, of the side support forming element of FIG. 6 shown in its assembled configuration.
Figure 7:
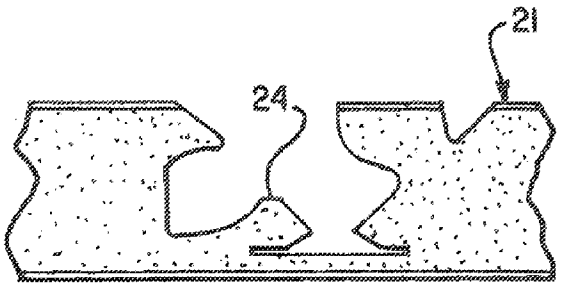
FIG. 7 is a top view, partially broken away, of the side support forming element of FIG. 6.

In order to provide clarity and understanding, FIGS. 7 and 8 are provided for depicting a more detailed view of the construction shown in FIG. 6 and employed for forming arcuately pivotable, right angle portion 24 of side support forming element/segments 21. By employing this construction, side support forming element/segments 21 are able to be shipped in a substantially flat configuration and then quickly and easily assembled to form the desired right angle portion 24.

As is evident from these additional views, each side support forming element/segment 21 is constructed with mating portions formed therein which are constructed for being quickly and easily positioned in locked interengagement with each other in order to form right angle portion 24. As discussed above, by employing this embodiment, the portions of side support forming element/segment 21 are arcuately pivoted towards each other enabling the integrally formed cut out portions to be brought into engagement with each other, causing the desired right angle portion 24 to be assembled. As a result, the desired right angle is achieved quickly and easily.

In FIG. 9, an alternative embodiment is depicted, wherein right angle portion 24 is formed with a flexible, pivotable construction which enables side support forming element/segment 21 to be shipped in a substantially flat configuration and, when desired, the portions thereof are arcuately pivoted to form right angle portion 24. Although locked interengaging elements are not employed, this configuration enables right angle portion 24 to be quickly and easily formed with the entire structure remaining in the precisely desired position, once side support forming elements/segments 21 are fully assembled.

In FIGS. 10 and 11, an alternate embodiment of side support forming element/segment 21 of side support system 20 of the present invention is depicted. In this embodiment, each side support forming element/segment 21 incorporates a locking flange member 30 extending from end 22, while end 23 thereof incorporates a complementary shaped cavity 31. In the embodiment depicted in FIGS. 10 and 11, locking flange member 30 comprises a keyhole shape, while cavity 31 comprises a similarly configured keyhole shape.

By employing this embodiment, two, cooperating side support forming elements/segments 21 are quickly and easily positioned in locked interengagement with each other, by merely inserting locking flange member 30 of one element/segment 21 into receiving cavity 31 of the second element/segment 21. Once all cooperating side support forming elements/segments 21 are mounted in locked interengagement with each other, mattress assembly 35 is peripherally surrounded in the desired manner, effectively completing the construction of the desired mattress. As a result, side support system 20 is able to be quickly and easily positioned in the desired location for providing the attributes inherent therewith.

In FIGS. 12 and 13, a still further embodiment of the present invention is depicted. In this embodiment, locking plates 32 are employed and are constructed for being inserted into receiving cavities 33. As depicted, elongated locking plates or strips 32 are mounted in receiving cavities 33 which are formed in side support forming element/segment 21, extending longitudinally therein.

By constructing each side support forming element/segment 21 with a plurality of substantially parallel, longitudinally extending cavities formed therein, locking plates 32 are able to be quickly and easily positioned in cavities 33, with each locking plate extending from one side support forming element/segment 21 to an adjacent side support forming element/segment 21, securely affixing the two elements/segments to each other. In this way, two adjacent side support forming elements/segments 21 are capable of being quickly and easily securely affixed to each other in order to achieve the desired peripherally surrounding engagement with any desired mattress construction. In addition, by employing this embodiment, corner forming segments 24 can be formed separately and easily affixed to elongated elements/segments 21.

Figure 15:
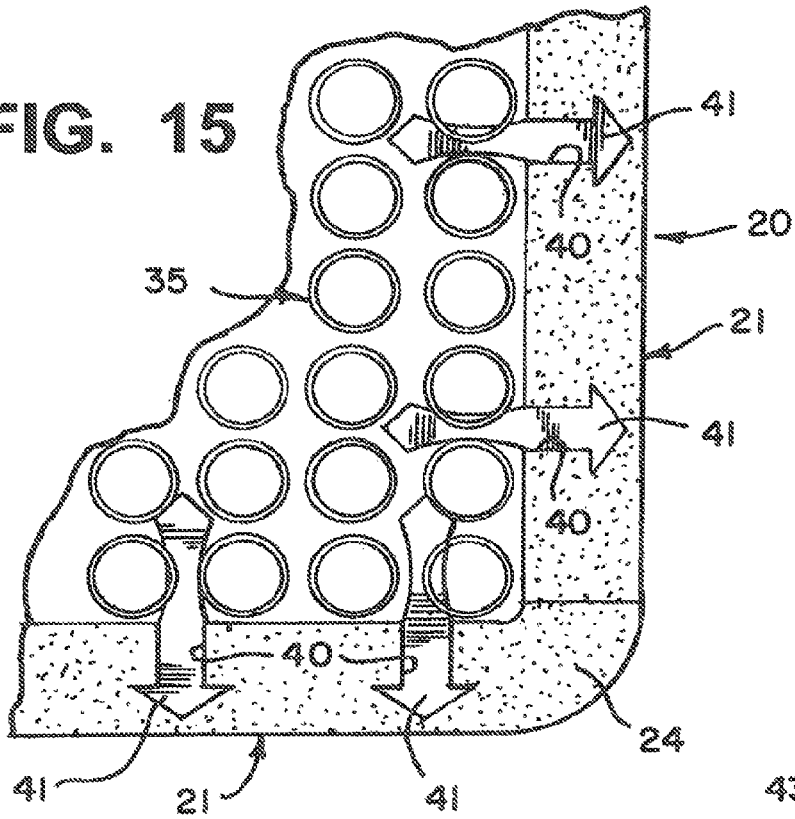
FIG. 15 is a top plan view of the side support forming element/segment of the side support system of FIG. 14 depicted in mounted and locked engagement with a mattress assembly.
Figure 16:
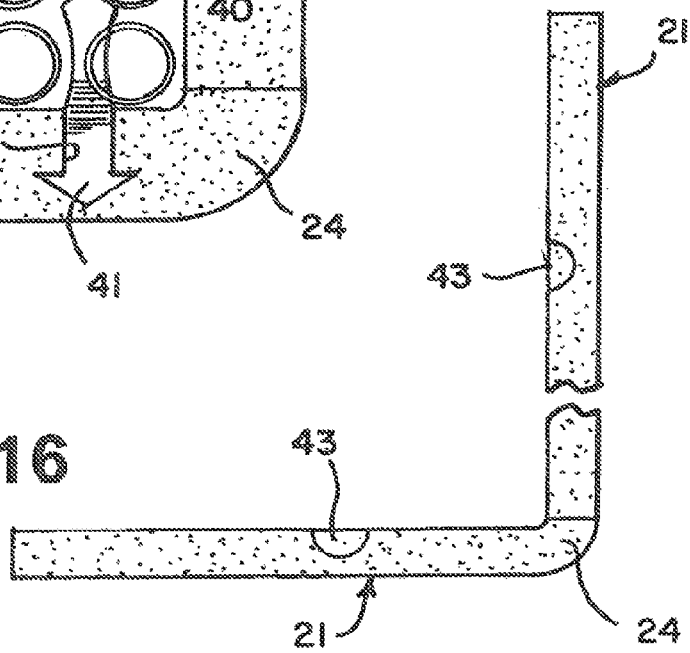
FIG. 16 is a top plan view of another still further alternate embodiment of the side support system of the present invention with the locking element of the side support forming element/segment in their first position.
Figure 17:
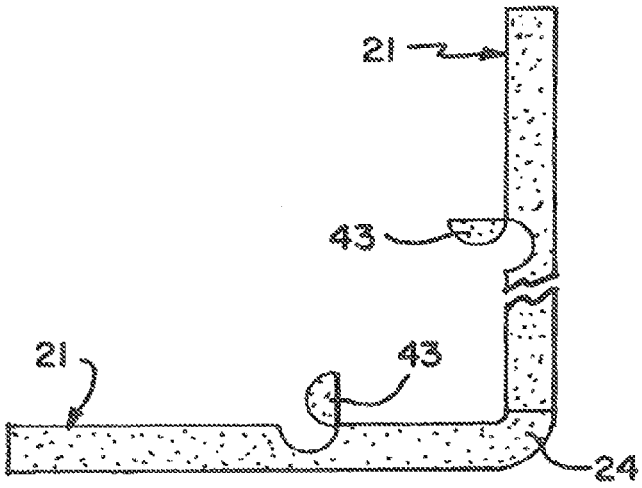
FIG. 17 is a top plan view of the side support forming element/segment of FIG. 16 with the locking element thereof mounted in their second engaging position.

By referring to FIGS. 14 and 15, along with the following detailed discussion, a still further alternate embodiment of the side support system 20 of the present invention can best be understood. In this embodiment, each side support forming element/segment 21 forming a component of the side support system 20 is constructed incorporating a plurality of key receiving cavities 40 formed in the inside wall thereof. Preferably, each key receiving cavity 40 is formed in juxtaposed, spaced, cooperating relationship with each adjacent key receiving cavity 40, extending about the interior surface of element/segment 21.

In this embodiment, each side support forming element/segment 21 is shipped as depicted in FIG. 14, with cavities 40 formed therein. In addition, a plurality of key elements 41 are shipped therewith, with each key element 41 being constructed for sliding, locked interengagement with a receiving cavity 40. When the assembly of this embodiment of side support system 20 is desired, key elements 41 are inserted in receiving cavities 40 resulting in a plurality of inwardly extending key elements formed therewith. Thereafter, inwardly extending key elements 41 are inserted between cooperating helical coils of mattress assembly 35, effectively establishing and securely mounting side support system 20 in the precisely desired position, with side support system 20 being in secure, locked engagement with mattress assembly 35.

In this embodiment, key elements 41 may be formed in any desired shape or configuration which will enable key elements 41 to be inserted into receiving cavities 40 on one end thereof and inserted between the helical coils of mattress assembly 35 at the opposed end thereof. As depicted, double headed arrow configurations represent one configuration which can be efficiently and effectively employed. However, numerous alternate configurations can be employed, with one or more shapes selected from the group consisting of dovetails, teardrops, jigsaws, rhombuses, semicircles, keyholes, bowties, and the like.

Furthermore, if desired, identical, similar, or totally different shapes can be employed at the opposed ends of key element 41 without departing from the scope of this invention. The only requirement is that each key element 41 be quickly and easily inserted into receiving cavities 40 of element/segment 21, while the opposed end thereof is quickly and easily inserted between the helical spring coils of mattress assembly 35.

In FIGS. 16-19, a still further alternate embodiment of side support system 20 of the present invention is depicted. In this embodiment, each side support forming element/segment 21 incorporates a plurality of key locking elements 43 integrally formed along the inside surface of element/segment 21. In addition, each key locking element 43 is constructed for being affixed to element/segment 21 and integrally attached thereto during shipment, while also being pivotally movable relative to element/segment 21 for enabling a portion of key locking element 40 to be engaged between cooperating helical coils of mattress assembly 35.

In the embodiment depicted, each key locking element 43 is constructed in a semicircular shape with one edge thereof being permanently affixed to element/segment 21. In this way, each key locking element 43 is easily arcuately pivotable from a first position, wherein key locking element 43 is completely contained within element/segment 21, to a second position wherein each key locking element 43 extends outwardly from the inside wall of the element/segment 21 at substantially right angles thereto.

When this embodiment of the present invention is employed, side support forming elements/segments 21 are shipped with key locking elements 43 securely affixed therewith. Once side support forming elements/segments 21 reach the desired location and are ready to be installed with mattress assembly 35, each key locking element 43 is merely arcuately pivoted from its first retained position into its second, extending position enabling each key locking element 43 to be inserted between the helical coil springs of mattress assembly 35. In this way, each side support forming element/segment 21 is quickly and easily affixed to mattress assembly 35, completing the desired structure and providing the advantages and benefits inherent with side support system 20.

As is evident from this disclosure, any alternate configuration can be employed for key locking element 43. As a result, any desired shape capable of being cut into the side wall of element/segment 21 and arcuately pivotable relative thereto, while also being affixed thereto, can be efficiently and effectively employed. Further advantages attainable by employing this embodiment of the present invention are the use of less material and fewer components, with a resulting construction which is easily assembled and installed. Furthermore, this configuration also provides optimal packing for both storage and shipment.

In FIG. 20, a still further alternate embodiment of the present invention is depicted. In this embodiment, side support system 20 is depicted as comprising a plurality of side support forming elements/segments 21 each of which are mounted peripherally surrounding mattress assembly 35 to form the desired final configuration. In this embodiment, a continuous, elongated, elastic band 48 is employed peripherally surrounding the assembly of side support forming elements/segments 21 for maintaining elements/segments 21 securely mounted with each other in the desired mounted position. By employing elastic band 48, complete assembly of side support system 20 is achieved conveniently and rapidly. If desired, a channel or slot can be formed in elements/segments 21 for receiving and retaining elastic band 48. In this way, elastic band 48 can be mounted peripherally surrounding the plurality of elements/segments 21 and be virtually hidden from view.

Figure 21:
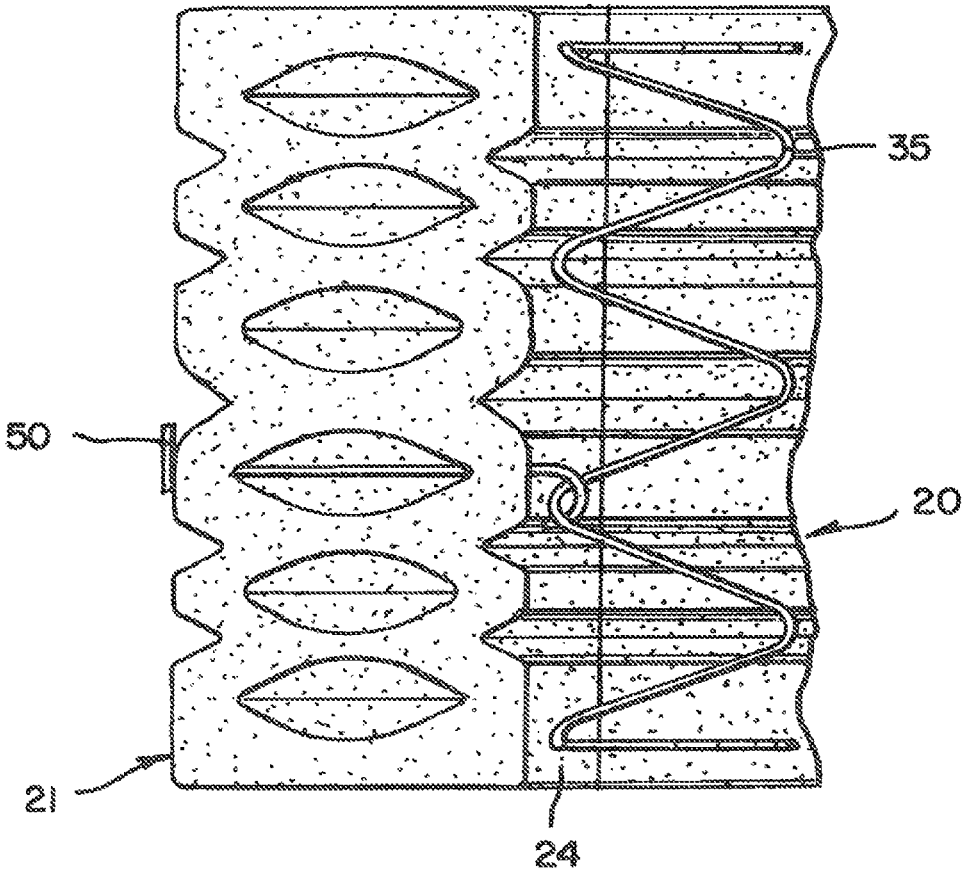
FIG. 21 is a cross-sectional side elevation view of a still further alternate embodiment of the side support system of the present invention employing a mechanical fastener to securely maintain the side support forming element/segments of the side support system to the mattress assembly.

In FIG. 21, a final alternate embodiment of the present invention is shown. In this embodiment, side support system 20 comprises a plurality of side support forming elements/segments 21 which peripherally surround and envelope mattress assembly 35, with each element/segment 21 being secured to mattress assembly 35 employing a mechanical fastener 50. As depicted in this embodiment, mechanical fastener 50 incorporates a J-shaped hook element which extends through the side wall of element/segment 21 and lockingly engages a portion of the helical coil springs forming mattress assembly 35. By securely mounting a plurality of mechanical fasteners 50 along the length of each element/segment 21, with each mechanical fastener securely engaged with a portion of the helical coil spring of mattress assembly 35, side support forming elements/segments 21 are securely affixed to mattress assembly 35 and retained in the precisely desired position.

It will thus be seen that the objects set forth above, among those made apparent from the preceding description, are efficiently attained and, since certain changes may be made in the above product without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

We claim:

1. A side support system for a mattress, comprising four foam members, each of the four foam members including a first terminating end;

a longitudinal axis;

a second terminating end opposite the first terminating end; and a living hinge disposed between the first terminating end and the second terminating end, the living hinge configured to move the first terminating end and the second terminating end between a first configuration and a second configuration, wherein for each of the four foam members in the first configuration, the second terminating end is opposite the first terminating end along the longitudinal axis of each of the four foam members, wherein for each of the four members in the second configuration, the first end and the second end are orientated at a ninety degree angle with respect to each other to thereby be configured to be in a cooperative surrounding relationship with a corner of the mattress assembly, wherein the first terminating end of each of the four foam members is configured to abut the first terminating end of another of the four foam members when the four foam members collectively surround a periphery of the mattress assembly, and the second terminating end of each of the four foam members is configured to abut the second terminating end of another of the four foam members when the four foam members collectively surround the periphery of the mattress assembly.

2. The side support system of claim 1, wherein the living hinge of each of the four foam members is configured to form a locked interengagement in the second configuration.

3. The side support system of claim 2, wherein the living hinge of each of the four foam members includes mating portions configured to be positioned in the locked interengagement.

4. The side support system of claim 3, wherein the mating portions of each of the four foam members are integral with each of the four foam members.

5. The side support system of claim 1, wherein the living hinge of each of the four foam members forms a fillet surface of each of the four foam members in the second configuration.

6. The side support system of claim 1, wherein each of the four foam members further comprises a key receiving portion formed in an inside wall of each of the four foam members, the key receiving portion is configured to receive a key element resulting in the key element to be inwardly extending and thereby be inserted between cooperating coils of the mattress assembly.

7. The side support system of claim 6, wherein the key receiving portion of each of the four foam members is configured to prevent the key element inserted into the key receiving portion from being pulled out orthogonally from the inside wall of one of the four foam members.

8. The side support system of claim 7, wherein the key receiving portion of each of the four foam members includes a contact surface at least partially facing away from the inside wall of each of the four foam members to prevent the key element from being pulled out orthogonally.

9. The side support system of claim 1, wherein each of the four foam members further comprises a key locking element configured to be inserted between cooperating coils of the mattress assembly.

10. The side support system of claim 9, wherein the key locking element of each of the four foam elements is integrally formed along an inside surface of each of the four foam members.

11. The side support system of claim 10, wherein the key locking element of each of the four foam elements is pivotably movable relative to a portion of the inside surface of each of the four foam members.

12. The side support system of claim 1, further comprising a plurality of first locking members configured to attach the first terminating end of each of the four foam members to the first terminating end of another of the four foam members when the four foam members collectively surround a periphery of the mattress assembly.

13. The side support system of claim 12, wherein the plurality of second locking members are configured to attach the second terminating end of each of the four foam members to the second terminating end of another of the four foam members when the four foam members collectively surround a periphery of the mattress assembly.

14. The side support system of claim 13, wherein each of the plurality of first locking members is configured to be inserted into a first receiving cavity of each of two of the four foam members, and each of the plurality of second locking members is configured to be inserted into a second receiving cavity of each of two of the four foam members.

15. The side support system of claim 14, wherein each of the plurality of first locking members and each of the plurality of second locking members include a cross-sectional shape of a double-headed arrow.

16. A side support system for a mattress, comprising four foam members and four foam corner members configured to collectively surround a periphery of a mattress assembly, each of the four foam members abuts and is attached to two of the four foam members with at least two of a plurality of elongated locking plates.

17. The side support system of claim 16, wherein each of the four foam members include a first terminating end including a first receiving cavity configured to receive a first portion of one of the plurality of elongated locking plates, a second terminating end opposite the first terminating end, and the second terminating end including a second receiving cavity configured to receive a first portion of another of the plurality of elongated locking plates.

18. The side support of claim 17, wherein each of the four foam corner members comprises a first receiving corner cavity configured to receive a second portion of one of the plurality of elongated locking plates, a second receiving corner cavity configured to receive a second portion of another of the plurality of elongated locking plates.

19. The side support of claim 16, wherein each of the four foam corner members comprises a fillet surface configured to face the mattress assembly.

* * * * *